US007481746B2

(12) United States Patent
Ibarguren

(10) Patent No.: US 7,481,746 B2
(45) Date of Patent: Jan. 27, 2009

(54) STATIC PEDALLING FITNESS APPARATUS WITH LATERAL SWINGING

(75) Inventor: Inigo Lizarralde Ibarguren, Bergara Gipuzkoa (ES)

(73) Assignee: Wingroup, S. Coop, Bergara Gipuzkoa (ES)

( * ) Notice: Subject to any disclaimer, the term of this patent is extended or adjusted under 35 U.S.C. 154(b) by 147 days.

(21) Appl. No.: 11/490,542

(22) Filed: Jul. 21, 2006

(65) Prior Publication Data

US 2008/0020908 A1 Jan. 24, 2008

(51) Int. Cl.
*A63B 22/06* (2006.01)
*A63B 69/16* (2006.01)

(52) U.S. Cl. ..... 482/57; 482/62

(58) Field of Classification Search ..... 482/57, 482/61, 62; 601/36; 434/61, 67
See application file for complete search history.

(56) References Cited

U.S. PATENT DOCUMENTS

| | | | | |
|---|---|---|---|---|
| 3,759,512 | A * | 9/1973 | Yount et al. | 482/62 |
| 4,463,945 | A * | 8/1984 | Spector | 482/62 |
| 4,555,109 | A * | 11/1985 | Hartmann | 482/62 |
| 4,586,706 | A * | 5/1986 | Chen | 482/62 |
| 5,035,418 | A * | 7/1991 | Harabayashi | 482/62 |
| 5,908,373 | A * | 6/1999 | Pitre | 482/57 |
| 6,126,577 | A * | 10/2000 | Chang | 482/57 |
| 6,648,802 | B2 * | 11/2003 | Ware | 482/57 |
| 7,081,070 | B1 * | 7/2006 | Washington et al. | 482/57 |
| 7,137,929 | B2 * | 11/2006 | Fan | 482/57 |
| 2002/0004439 | A1 * | 1/2002 | Galbraith et al. | 482/57 |
| 2004/0053751 | A1 * | 3/2004 | Pizolato | 482/61 |
| 2005/0209064 | A1 * | 9/2005 | Peterson et al. | 482/61 |

* cited by examiner

*Primary Examiner*—S. R. Crow
*Assistant Examiner*—Allana Lewin
(74) *Attorney, Agent, or Firm*—Browdy and Neimark, P.L.L.C.

(57) ABSTRACT

Static pedalling fitness apparatus (1) that, with great accuracy, simulates the real excercise of pedalling on a conventional road biclycle while standing up and swinging the bicycle sideways. For this purpose, the fitness apparatus (1) comprises a fixed part (2) which is basically unmovable with respect to the floor, a movable part (3) which is capable of swinging laterally with respect to the fixed part (2) and which includes the set of pedals (4) and the seat (5), and another tilting part that is the handlebar (6) of the apparatus (1). The handlebar (6) is capable of oscillating separately from the oscillation of the movable part (3), i.e. the handlebar (6) presents a relative swinging movement with respect to the set of pedals (4) and the seat (5).

15 Claims, 6 Drawing Sheets

STATIC PEDALLING FITNESS APPARATUS WITH LATERAL SWINGING

FIELD OF THE INVENTION

The invention relates to a static fitness apparatus for practicing cycling exercises simulating the exercise performed in real conditions on a conventional bicycle.

PRIOR ART

In the prior art, many types of pedalling fitness apparatus are known that allow a user to perform a pedalling exercise in static conditions which simulates the pedalling exercise on a dynamic or conventional bicycle. These types of pedalling fitness apparatus may be essentially divided into two large groups. The first group can be referred to as "adaptor" pedalling fitness apparatus, and consists basically of a structure that is capable of receiving and holding a conventional bicycle by generally supporting it on rollers or similar elements, in such a way that the apparatus allows the conventional bicycle to be used in static conditions. The second group, "static" pedalling fitness apparatus generally known as "static bicycles", is an apparatus designed for its exclusive static use. In other words, it does not incorporate wheels or other elements associated with the dynamic operation of a conventional bicycle, but instead generally consists of a frame supported on the floor incorporating a seat, pedals and a handlebar.

Both groups of pedalling apparatus are evolving so that the exercise conditions perceived by the user of the pedalling apparatus simulate as far as possible the exercise conditions perceived by the user on a conventional bicycle. In this respect, one of the evolutions that both groups of pedalling fitness apparatus are undergoing is the incorporation of the ability to swing laterally, to simulate the pedalling conditions perceived by a cyclist when pedalling standing up on a conventional bicycle (e.g., when ascending a cliff, sprinting, etc.).

As far as the second group of pedalling apparatus or static bicycles is concerned, the incorporation of the lateral swinging has been carried out in different ways.

For example, some static pedalling fitness apparatus provide a feeling of lateral swinging by featuring a handlebar that oscillates on a transversal, vertical plane. Obviously, this design does not fully reproduce real pedalling conditions, for two reasons essentially: when the user pedals standing up, only the handlebar oscillates, whilst in real conditions the whole bicycle oscillates; also, the fitness apparatus does not force the user to swing the handlebar to pedal more comfortably, but rather the fitness apparatus is stable in itself and the user could be able to pedal standing up without forcing the handlebar to swing, whilst in real conditions it is extremely complicated to pedal standing up without swinging the handlebar and the rest of the bicycle.

Other static pedalling fitness apparatus achieve lateral swinging by including two frames, one of which is fixed and is supported on the ground and the other of which swings transversely and incorporates the seat, pedals and the handlebar. Again, this type of apparatus is stable in itself. In other words, it does not force the user pedalling standing up to swing the handlebar and other elements of the swinging frame. Instead, the user can pedal without swinging the handlebar, and can optionally swing the handlebar and other elements to pedal more comfortably. Stability is achieved by incorporating springs which tend to keep the swinging frame vertical, in an attempt to reproduce the gyroscopic effect of the wheels provided in conventional bicycles (effect in which as the wheels turn, they tend to remain in position, and thanks to which it is possible to ride a bicycle without falling off). When the swinging frame is moved from its vertical rest position, the swinging frame begins to oscillate with respect to the vertical rest position with a frequency depending on the model of the fitness apparatus and the weight and size of the user. The user may continue pedalling even if the frame swinging and the pedalling are not simultaneous. Logically, this de-synchronization does not occur in real conditions. Therefore, this type of fitness apparatus does not optimally simulate the real pedalling conditions perceived by the user when pedalling standing up on a conventional bicycle.

The present invention aims to design a static pedalling fitness apparatus which, as reliably as possible, simulates the lateral oscillation of a conventional bicycle when the cyclist pedals standing up, while guaranteeing that the feeling of stability and confidence perceived by the user while training is maximised. Additionally, the fitness apparatus according to the invention should, as exactly as possible, simulate the feeling of stability perceived by the cyclist due to the gyroscopic effect of the wheels when turning.

SUMMARY OF THE INVENTION

The object of the invention is a static pedalling fitness apparatus that simulates, with a high level of accuracy, the kind of pedalling exercise on a conventional bicycle where the user pedals while standing up on the bicycle having the bicycle swing sideways. For this purpose, the static pedalling fitness apparatus essentially comprises three parts that show a relative movement between them, instead of two as designs known in prior art do. Specifically, the static pedalling fitness apparatus according to the invention comprises a fixed part anchored to the floor or similar (preferably providing this fixed part with a certain weight and supporting it on the floor by means of highly stable legs), a movable part that is capable of swinging sideways with respect to the fixed part and that includes the pedals and the seat, and another oscillating part which basically provides the handlebar of the fitness apparatus. The handlebar is capable of swinging apart from the swinging of the movable part, i.e. the handlebar presents a relative swinging movement with respect to the pedals and the seat.

Although other embodiments are contemplated, the preferred embodiment is that in which the movable part is connected by means of an articulated junction to the fixed part, and the handlebar is connected by means of an articulated junction to the movable part. Preferably, there are some pieces that relate the handlebar swinging to the movable part swinging, and other mechanisms that dampen and limit the handlebar swinging with respect to the movable part.

Therefore, in the fitness apparatus according to the invention there are two oscillations: the lateral swinging of the movable part (seat and pedals) and, superimposed, the swinging of the handlebar. The handlebar swings with a greater amplitude than the fixed part, being this a characteristic that enhances the accurate simulation of the behaviour of a conventional bicycle when the cyclist pedals standing up and forcing a lateral swing. Additionally, the swinging of the movable part and the swinging of the handlebar are preferably related. Because the user's legs act on one of the parts and the user's arms act on another, the user has full control of the fitness apparatus, being able to maintain his/her balance in a similar way as when pedalling in real road conditions.

In real road conditions, when the cyclist stands up on the bicycle (which generally occurs in situations in which a lot of power needs to be developed, for example, on steep slopes or in high speed racing or sprinting), the pedalling is performed as follows: the cyclist, when extending one leg to pedal with it, is intuitively obliged to balance the effort of the leg by inclining the handlebar towards the opposite side of the pedalling leg and moving the bicycle's and his/her own centre of gravity of towards the opposite side, the sideways swinging taking place as a result of succesive pedalling actions; during the sideways swinging, the cyclist makes use of the horizontal turning of the handlebar (provided by conventional bicycles so that the cylist can vary the direction of the front wheel) to gain stability. It has been verified that the feeling perceived by the cyclist when swinging on a conventional bicycle provided with horizontal turning of the handlebar is reproduced quite accurately by the fitness apparatus according to the invention. This accuracy is achieved because the handlebar of the present apparatus can swing with respect to the movable part that comprises the seat and the pedals, and because the net amplitude of the handlebar swing is greater than the net amplitude of the movable part swing.

Like in real pedalling conditions, the fitness apparatus forces the user to find his/her balance when pedalling standing up. To maintain the balance, the user soon realizes that it is easier to swing the fitness apparatus in the opposite direction to the foot that is making the pedalling effort. Unconsciously, the user perceives that it is easy to maintain this swinging whilst pedalling.

The static pedalling fitness apparatus according to the invention comprises blocking elements that allow to block all swinging so that the apparatus can be used as a conventional non-swinging static pedalling fitness apparatus.

BRIEF DESCRIPTION OF THE FIGURES

The details of the invention can be seen in the accompanying figures, which do not intend to be limitative to the scope of the invention.

DETAILED DESCRIPTION OF THE INVENTION

Figure 1:
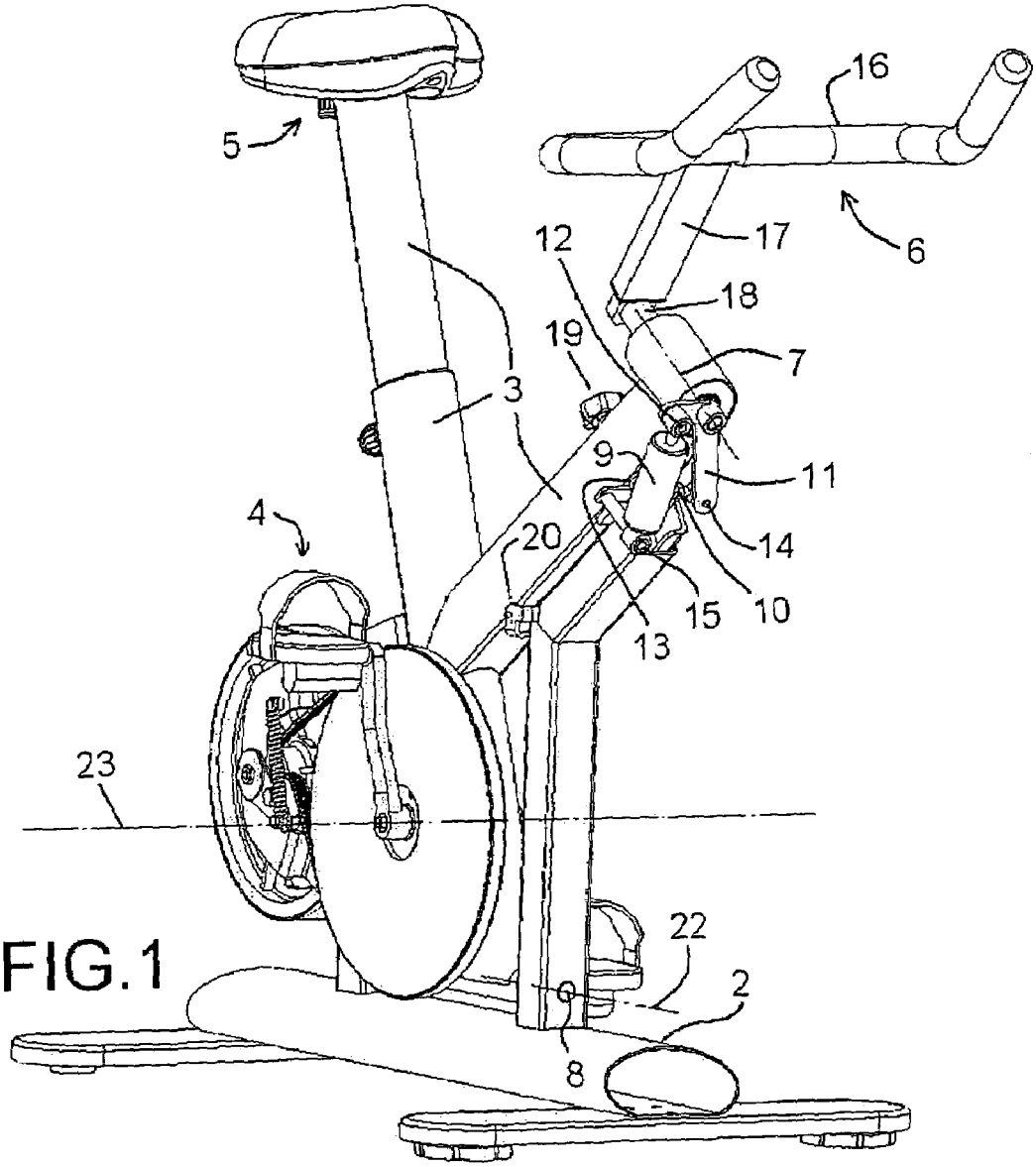
FIG. 1 shows a perspective of an embodiment of the fitness apparatus according to the invention, in a rest position.

FIG. 1 pictures a perspective of an embodiment of the invention shown in rest position, i.e. with no swinging of any element with respect to the floor. The static pedalling fitness apparatus (1) comprises a fixed part (2) provided with a stabilizer (21). The fixed part (2) does not present any movement with respect to the floor. The fitness apparatus (1) also comprises a movable part (3) which can swing laterally with respect to the fixed part (2). The movable part (3) includes the pedals (4) and the seat (5) of the fitness apparatus (1). Therefore, both elements (4, 5) form part of the same movable part (3) and therefore swing laterally together with the rest of the movable part (3).

The movable part (3) oscillates with respect to the fixed part (2) specifically with respect to a turning axis (22). The turning axis (22) is located substantially below the crank axle (23) or pedalling axis, so that the fitness apparatus (1) does not tend to be stable and the user, when pedalling standing up, feels the need to swing the fitness apparatus (1). In a preferred embodiment as shown in the figure, the turning axis (22) is located relatively close to the floor in order to simulate the swinging of a conventional bicycle frame with respect to the turning axis given by the line formed by the contact points of the wheels with the ground.

The handlebar (6) of the fitness apparatus (1), which in the case of the figure comprises of a handlebar gripping zone (16), a handlebar support (17) and a handlebar support bar (18), can swing with respect to the fixed part (2) and/or the movable part (3). Preferably, as is represented in the figure, the handlebar (6) swings with respect to the movable part (3), i.e. the handlebar (6) is connected to the moveable part (3) by means of an articulated junction (7). Therefore, the swinging of the handlebar (6) with respect to the movable part (3) is turned into a lateral swinging of the handlebar (6) with respect to the fixed part (2). The invention contemplates other embodiments in which the handlebar (6) does not swing directly with respect to the movable part (3). In these embodiments the handlebar (6) is not articulately connected to the moveable part (3) but is connected to other elements, e.g., an element joined to the fixed part (2). However, in any case, the respective swinging of the handlebar (6) and of the movable part (3) with respect to the fixed part (2) will be such that the handlebar (6) presents a relative oscillation or swinging with respect to the pedals (4) and the seat (5).

The articulated junction (7) of the handlebar (6) is preferably positioned so that the axis of the articulated junction (7) presents an inclination with respect to the floor or horizontal plane of between 15 and 45°. An inclination of 30° is considered a particularly advantageous solution. By means of these inclinations, the handlebar (6) swings with a greater amplitude on the lateral plane than on the horizontal plane, making the fitness apparatus (1) easier to handle and simulating with greater accuracy the real swing of a handlebar.

As can be seen in the figure, because that the movable part (3) swings with respect to the fixed part (2), the effect of having the swing of the handlebar (6) with respect to the fixed part (2) present a greater amplitude than the swing of the movable part (3) with respect to the fixed part (2) is achieved, understanding the amplitude to be the degree of deviation from the vertical position. This effect helps the fitness apparatus (1) simulate swinging pedalling on a conventional bicycle. In other embodiments, the swinging of the handlebar (6) and the movable part (3) would have to be configured to achieve this same effect.

In a particularly advantageous solution, the swinging between the handlebar (6) and the fixed part (2) and/or the movable part (3) is dependent on the swinging of the movable part (3) with respect to the fixed part (2). In other words, the swinging of the handlebar (6) is not completely independent of the swinging of the movable part (3), but there is some element that connects both pieces (3, 6), of course in an articulated way, so that the swinging of the handlebar (6) produces the swinging of the movable part (3). It must be taken into account that, when pedalling standing up on a conventional bicycle, the swinging of the bicycle is forced by the cyclist's arms, which act on the handlebar to counteract the effort made by the legs, allowing the efforts to be balanced and at the same time allowing the legs to perform a more effective and powerful pedalling on the pedals. In this respect, when inclining the bicycle in the opposite direction to the pedalling, the cyclist ensures that part of the necessary effort to move the bicycle is performed by the arms, freeing the legs to a certain degree and shifting part of the load to the upper part of the cyclist's body. Therefore, in the fitness apparatus (1) according to the invention, it is particularly advantageous that when the user initiates or forces the tilting of the handlebar (6), a swiging of the movable part (3) which comprises the seat (5) and the pedals (4) it produced as a consequence. On the other hand, by limited it is understood that the balancing of the handlebar (6) with respect to the movable part (3) should not exceed a maximum amplitude, resembling conventional bicycles; otherwise a feeling of instability would be produced for the user of the fitness apparatus (1).

In a preferable embodiment, the relation and limitation of the swinging of the handlebar (6) with respect to the movable part (3) is achieved using a junction lever (10), connected between the handlebar (6) and the fixed part (2) via some respective articulated junctions (14, 13).

Additionally, the static pedalling fitness apparatus (1) according to the invention can comprise a blocking system (19) which partially or fully blocks the movable part (3) and/or the handlebar (6) in order to respectively hinder or prevent their swinging. In the case of the figure, the blocking system (19) connects the movable part (3) to the fixed part (2). Because the tilting of the movable part (3) and the handlebar (6) are related, the blocking system (19) manages to immobilize not only the movable part (3) but also the handlebar (6).

The static pedalling fitness apparatus (1) according to the invention preferably comprises the necessary means to cushion or dampen the swinging between the handlebar (6) and the fixed part (2) and/or the movable part (3). These necessary means will avoid that the user perceives that the handlebar (6) tilts too loosely with respect to the movable part (3), as excess looseness would lead to a feeling of instability for the user. The dampening therefore allows the apparatus to simulate the inertia to turning which are caused by the gyroscopic effect of the wheels in real conditions.

As can be seen in the figure, these necessary means may be a movement damper (9), in this case in the form of a dual-direction hydraulic cylinder, connected between the handlebar (6) and the movable part (3) via the respective articulated junctions (12, 15). However, the invention contemplates other embodiments such as the inclusion of two movement dampers (9) in the form of two single-direction hydraulic cylinders, or even not using external movement dampers (9) as such, but rather using articulated junctions (7, 8) provided with an appropriate friction. Additionally, the invention contemplates connecting the movement damper (9) not only between the handlebar (6) and the movable part (3) but also between the handlebar (6) and the fixed part (2), between the movable part (3) and the fixed part (2), and even including various movement dampers (9) connecting the same or different elements (2, 3, 6), etc.

Figure 2:
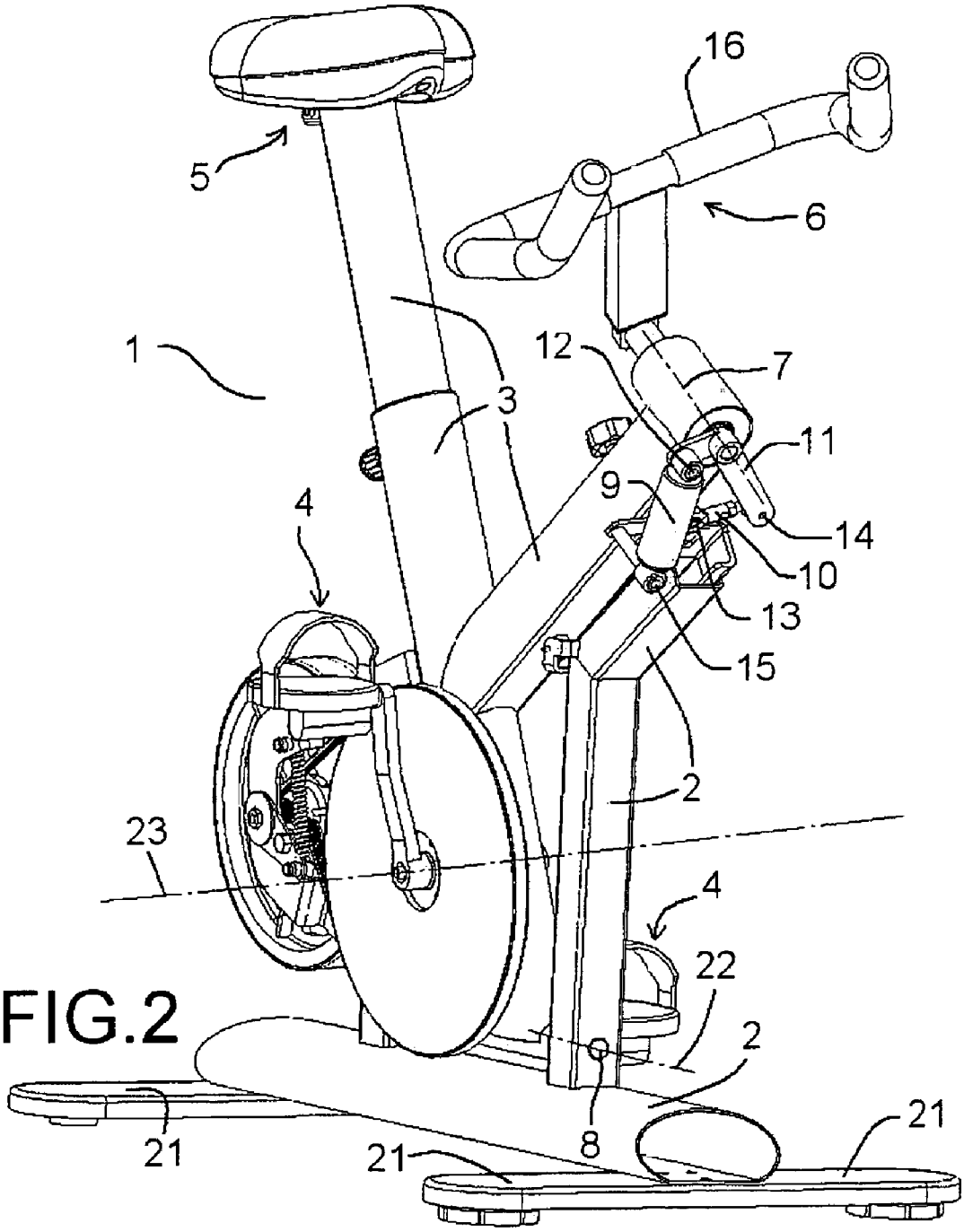
FIG. 2 shows the fitness apparatus of FIG. 1, whereby the movable part and the handlebar have swinged towards the right.

FIG. 2 shows the fitness apparatus (1) of the previous figure following the tilting of the movable part (3) and the handlebar (6) towards the right, determining the left and right directions from the point of view of the user using the fitness apparatus (1). Specifically, the movable part (3) has tilted laterally with respect to the articulated junction (8) and the handlebar (6) has tilted laterally with respect to the articulated junction (7), both articulated junctions (7, 8) having been represented in the form of turning axes for tilting. Similarly, FIG. 3 shows the opposite case, in which the movable part (3) and the handlebar (6) have tilted towards the left.

Figure 3:
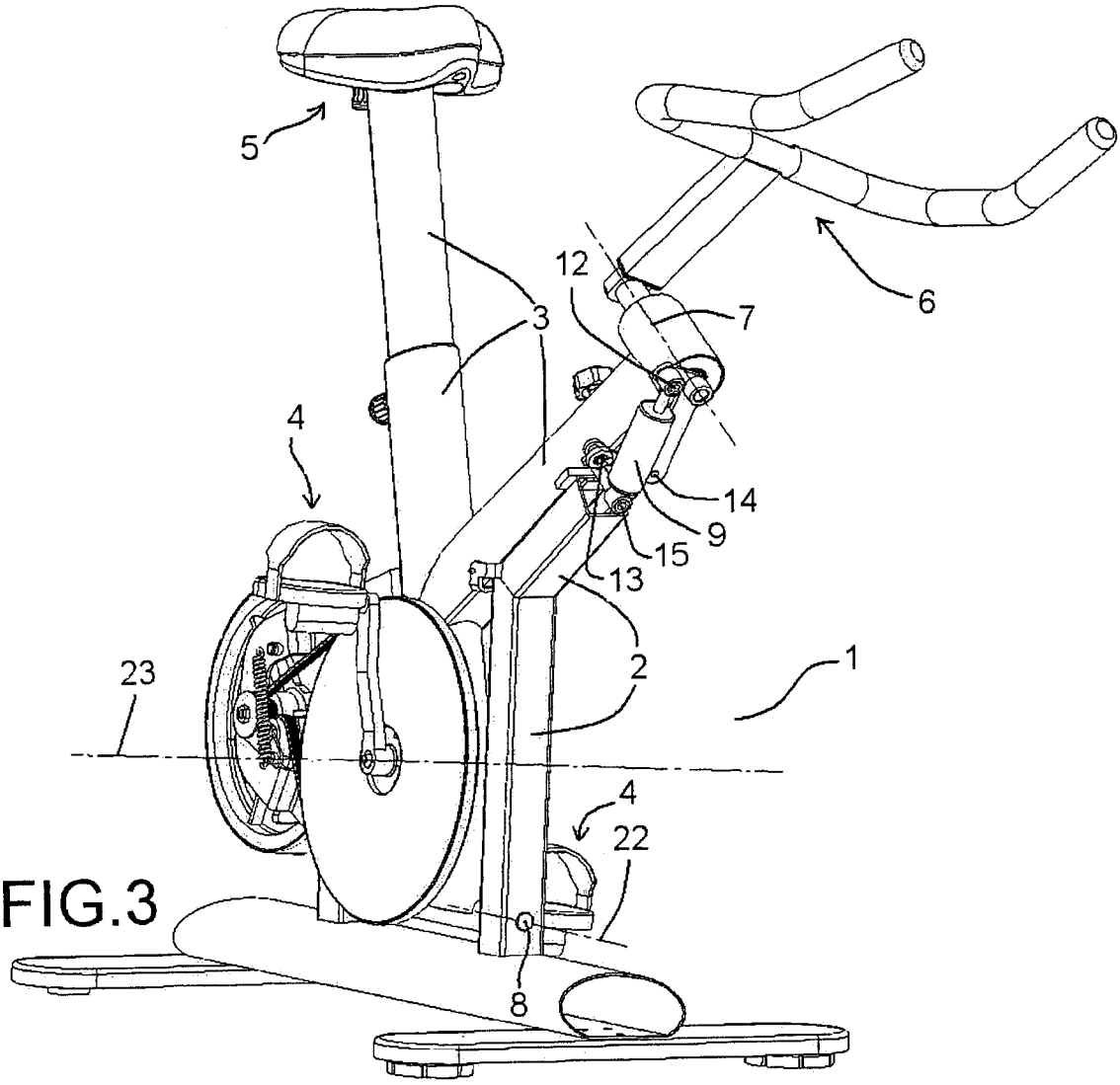
FIG. 3 shows the fitness apparatus of FIG. 1, whereby the movable part and the handlebar have swinged towards the left.
Figure 4:
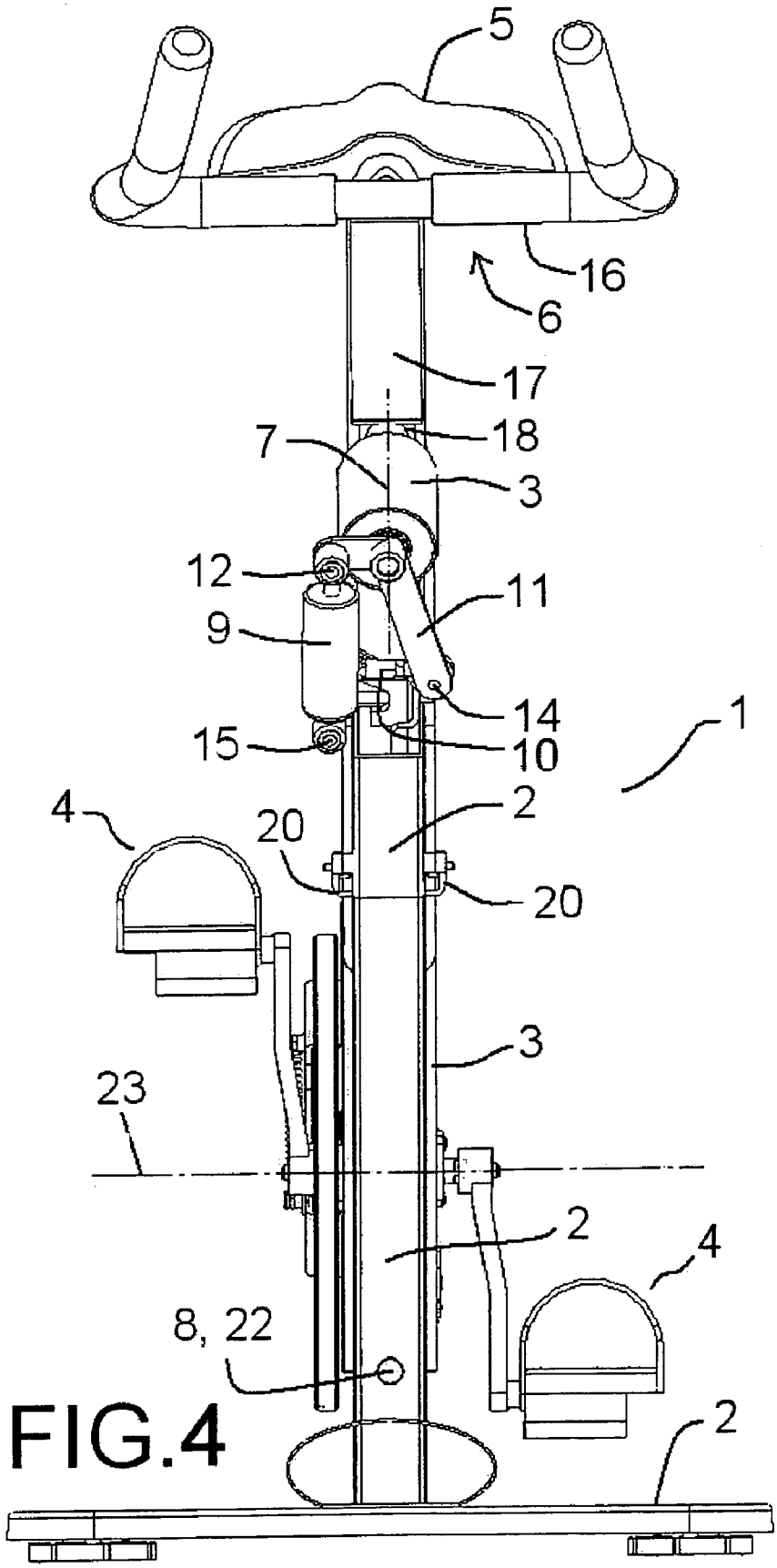
FIG. 4 shows a front view of the fitness apparatus of FIG. 1.
Figure 5:
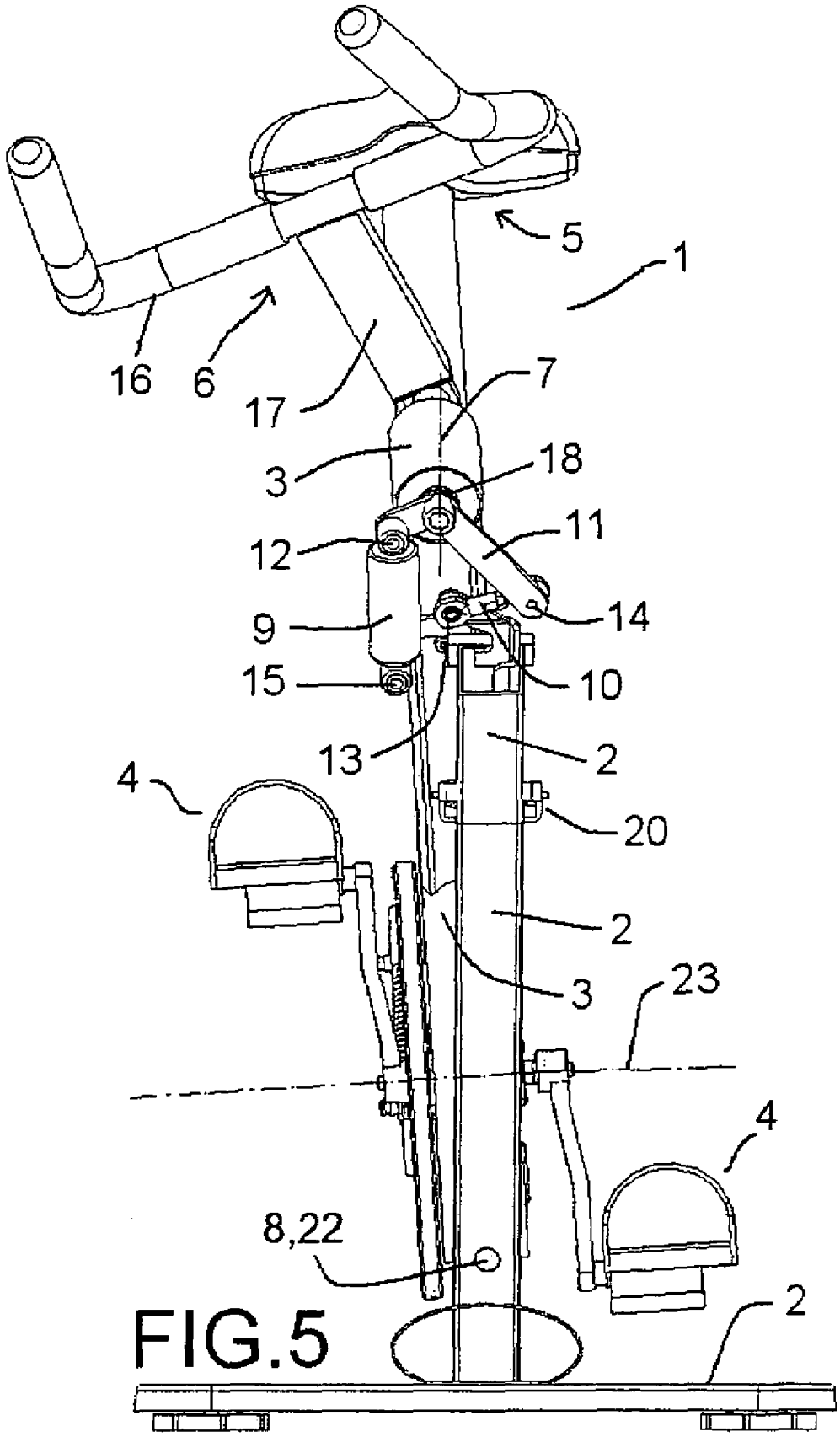
FIG. 5 shows a front view of the fitness apparatus of FIG. 2.
Figure 6:
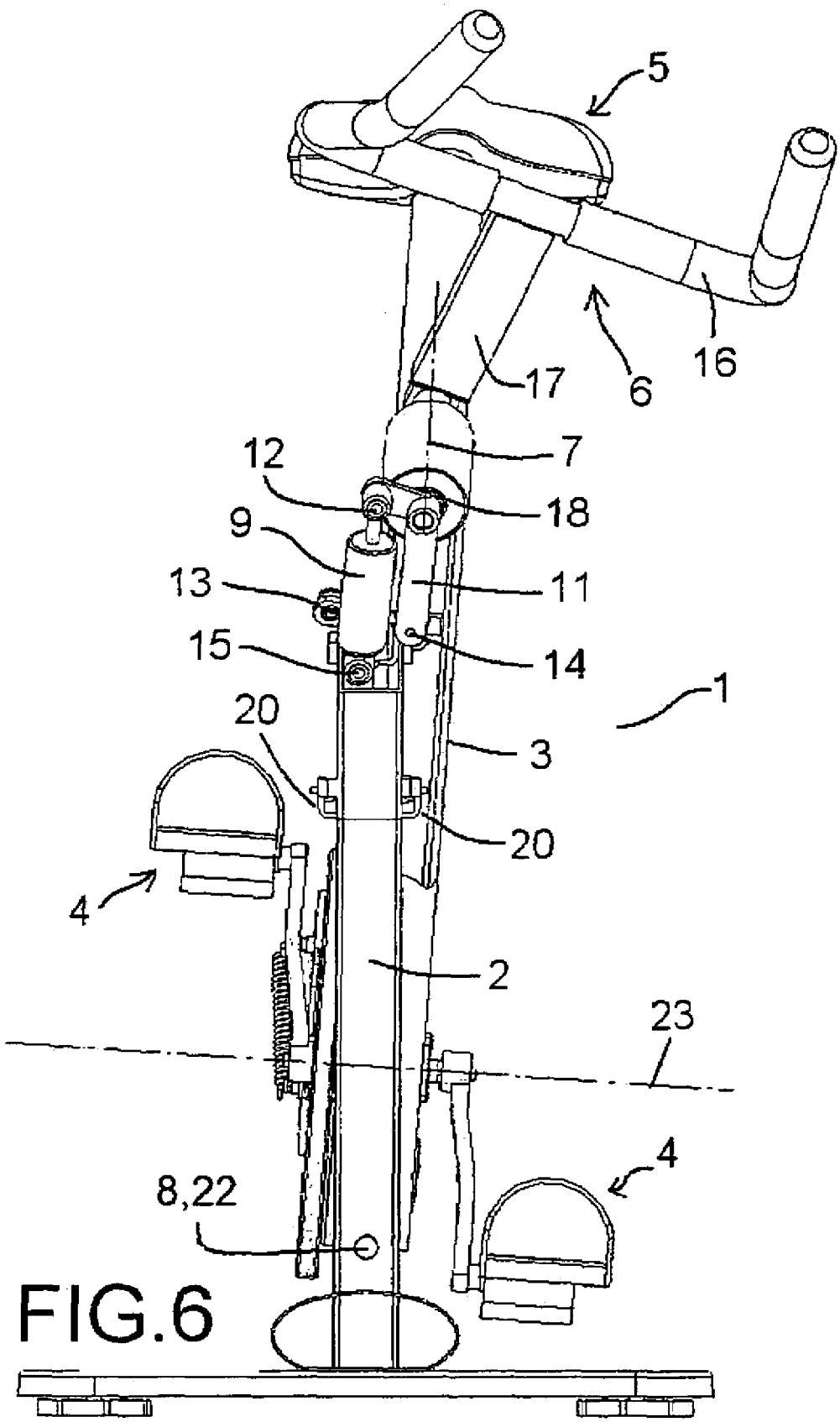
FIG. 6 shows a front view of the fitness apparatus of FIG. 3.

FIGS. 4 to 6 show the respective front views of the fitness apparatus (1) in FIGS. 1 to 3. In FIG. 4, the movable part (3) and the handlebar (6) are shown in the vertical of the fitness apparatus (1), i.e. show no tilting. In FIG. 5, the movable part (3) and the handlebar (6) have oscillated towards the right and, as can be seen, the handlebar (6) has done so with a greater angle than the movable part (3). Similarly, FIG. 6 shows the elements (3, 6) displaced towards the left.

In the three figures, the elements that preferably intervene in the relation, limitation and dampening of the movable part (3) swinging and the handlebar (6) swinging can be clearly seen. First, a metal plate (11) is preferably joined to the handlebar (6). In the case of the Figure, the metal plate (11) is connected to the end of the handlebar support bar (18) of the handlebar (6) by soldering or another method. The metal plate (11), which in this case is in the shape of an L, provides the articulated junction (12) between the damper element (9) and the handlebar (6) and the articulated junction (14) between the junction lever (10) and the handlebar (6). In the case of the metal plate in the shape of an L shown in the figures, the longer the "long" side of the L, i.e. the side between the handlebar support bar (18) and the articulated junction (14), the less the handlebar (6) has to swing in order to the swing the movable part (3). Therefore, by varying the length of this side of the L, it is possible to adapt the fitness apparatus (1) to users who are more or less expert in this type of pedalling with swinging. Second, the fitness apparatus (1) preferably comprises lateral bumpers (20) which limit the lateral swinging of the movable part (3) with respect to the fixed part (2), so that the movable part (3) may not be tilted beyond a specified maximum angle.

The fitness apparatus (1) according to the invention does not present any means that tend to return the movable part (3) and the handlebar (6) back to the vertical position of FIGS. 1 and 4. The aforementioned mechanisms (dampers, limiting mechanisms, etc.) serve to relate the relative movement of the handlebar (6), the seat (5) and the pedals (4) in a way as close as possible to reality, and perform this relation in a manner that does not vary depending on the tilting angle in which these elements (4, 5, 6) are found. The user of the fitness apparatus (1) then has the feeling that the swinging elements (3, 4, 5) may stabily remain in a tilted position, i.e. has the same feeling as that produced by the gyroscopic effect of a real bicycle. In an opposite manner, in fitness apparatus in the prior art which use springs to return the swinging structures to the vertical position, the action of the springs varies depending on the tilting angle of the swinging parts. Therefore, the use of springs does not manage to simulate the feeling perceived by the user in connection with the gyroscopic effect.

The invention claimed is:

1. Static pedalling fitness apparatus (1) for the performance of physical exercise by a user on a floor, comprising a set of pedals (4) which turn on to a crank axle (23), a seat (5) and a handlebar (6), said apparatus further comprising:

a fixed part (2) which does not move with respect to the floor, the set of pedals (4) and the seat (5) fixed on a movable part (3) which is engaged on the fixed part (2) and swings with respect to the fixed part (2) laterally around a turning axis (22) located along the length of the apparatus and below the crank axle (23) located perpendicular to the turning axis (22), wherein the handlebar (6) swings on an articulated junction (7) that connects the handlebar (6) to the fixed part (2) and/or the movable part (3) and swings relative to the pedals (4) and the seat (5) along the length of the crank axle (23) separate from the turning axis, wherein the handlebar (6) swings with respect to the fixed part (2) a greater amplitude than the movable part (3) swings with respect to the fixed part (2).

2. Static pedalling fitness apparatus (1), according to claim 1, characterized in that the turning axis (22) is located relatively close to the floor.

3. Static pedalling fitness apparatus (1), according to claim 1, characterized in that the articulated junction (7) connects the handlebar (6) to the movable part (3).

4. Static pedalling fitness apparatus (1), according to claim 1, characterized in that the articulated junction (7) of the handlebar (6) presents an axis with an inclination with respect to the floor of between 15 and 45°.

5. Static pedalling fitness apparatus (1), according to claim 4, characterized in that the articulated junction (7) of the handlebar (6) presents an axis with an inclination with respect to the floor of 30°.

6. Static pedalling fitness apparatus (1), according to claim 1, characterized in that it comprises a blocking system (19) which can at least partially block the movable part (3) and/or the handlebar (6) to hinder or prevent its swinging.

7. Static pedalling fitness apparatus (1), according to claim 1, characterized in that the swinging between the handlebar (6) and the fixed part (2) and/or the movable part (3) and the swinging of the movable part (3) with respect to the fixed part (2) are dependent on each other.

8. Static pedalling fitness apparatus (1), according to claim 7, characterized in that it comprises at least one junction lever (10), connected between the handlebar (6) and the fixed part (2) through respective articulated junctions (14, 13).

9. Static pedalling fitness apparatus (1), according to claim 7, characterized in that it comprises a blocking system (19) which can at least partially block the movable part (3) and/or the handlebar (6) to hinder or prevent its swinging, where the blocking system (19) connects the movable part (3) to the fixed part (2), where the partial or total blocking of the swinging of the movable part (3) blocks the swinging of the handlebar (6).

10. Static pedalling fitness apparatus (1), according to claim 1, characterized in that the tilting between the handlebar (6) and the fixed part (2) and/or the movable part (3) is dampened.

11. Static pedalling fitness apparatus (1), according to claim 10, characterized in that it comprises at least one movement damper (9), connected between the handlebar (6) and the movable part (3) through respective articulated junctions (12, 15).

12. Static pedalling fitness apparatus (1), according to claim 11, characterized in that it comprises at least one junction lever (10), connected between the handlebar (6) and the fixed part (2) through respective articulated junctions (14, 13), and that it comprises a metal plate (11) in solidarity to the handlebar (6), where said metal plate (11) comprises the articulated junction (12) between the movement damper (9) and the handlebar (6) and the articulated junction (14) between the junction lever (10) and the handlebar (6).

13. Static pedalling fitness apparatus (1), according to claim 1, characterized in that the lateral swinging of the movable part (3) with respect to the fixed part (2) is limited by at least a lateral bumper (20) in solidarity to the fixed part (2).

14. Static pedalling fitness apparatus (1) for the performance of physical exercise by a user, which comprises a set of pedals (4) capable of turning with respect to a crank axle (23), a seat (5) and a handlebar (5), which is characterized in that it comprises:

a fixed part (2), which presents no substantial movement with respect to the floor, a movable part (3), comprising the set of pedals (4) and the seat (5), and which may swing with respect to the fixed part (2), said swing taking place with respect to a turning axis (22) located substantially below the crank axle (23), where the handlebar (6) may swing with respect to an articulated junction (7) that connects the handlebar (6) to the fixed part (2) and/or the movable part (3), presenting a relative swinging movement with respect to the pedals (4) and the seat (5), presenting the swinging of the handlebar (6) with respect to the fixed part (2) an substantially greater amplitude than the swinging of the movable part (3) with respect to the fixed part (2);

wherein the articulated junction (7) of the handlebar (6) presents an axis with an inclination with respect to he floor of between 15 and 45°.

15. Static pedalling fitness apparatus (1) for the performance of physical exercise by a user, which comprises a set of pedals (4) capable of turning with respect to a crank axle (23), a seat (5) and a handlebar (6), which is characterized in that it comprises:

a fixed part (2), which presents no substantial movement with respect to the floor, a movable part (3), comprising the set of pedals (4) and the seat (5), and which may swing with respect to the fixed part (2), said swing taking place with respect to a turning axis (22) located substantially below the crank axle (23), where the handlebar (6) may swing with respect to an articulated junction (7) that connects the handlebar (6) to the fixed part (2) and/or the movable part (3), presenting a relative swinging movement with respect to the pedals (4) and the seat (5), presenting the swinging of the handlebar (6) with respect to the fixed part (2) an substantially greater amplitude than the swinging of the movable part (3) with respect to the fixed part (2), the swinging between the handlebar (6) and the fixed part (2) and/or the movable part (3) and the swinging of the movable part (3) with respect to the fixed part (2) are dependent on each other; and a blocking system (19) which can at least partially block the movable part (3) and/or the handlebar (6) to hinder or prevent its swinging, where the blocking system (19) connects the movable part (3) to the fixed part (2), where the partial or total blocking of the swinging of the movable part (3) blocks the swinging of the handlebar (6).

* * * * *